US005818403A

United States Patent [19]

Nakamura et al.

[11] Patent Number: 5,818,403

[45] Date of Patent: Oct. 6, 1998

[54] ELECTRON BEAM-GENERATING APPARATUS, IMAGE-FORMING APPARATUS, AND DRIVING METHODS THEREOF

[75] Inventors: Naoto Nakamura, Isehara; Ichiro Nomura, Atsugi; Hidetoshi Suzuki, Fujisawa; Tetsuya Kaneko, Yokohama; Shinya Mishina, Nara, all of Japan

[73] Assignee: Canon Kabushiki Kaisha, Tokyo, Japan

[21] Appl. No.: 631,155

[22] Filed: Apr. 12, 1996

Related U.S. Application Data

[63] Continuation of Ser. No. 174,448, Dec. 28, 1993, abandoned.

[30] Foreign Application Priority Data

Jan. 7, 1993 [JP] Japan ..... 5-001224

[51] Int. Cl.[6] ..... G09G 3/22; H01J 1/02

[52] U.S. Cl. ..... 345/74; 313/309

[58] Field of Search ..... 345/55, 74, 75, 345/204, 208, 210; 315/169.1, 169.2, 167, 168; 313/309

[56] References Cited

U.S. PATENT DOCUMENTS 4,682,239 7/1987 Watanabe ..... 345/74

4,763,187 8/1988 Biberian ..... 348/796

FOREIGN PATENT DOCUMENTS 1200532 8/1989 Japan .

2056822 2/1990 Japan .

OTHER PUBLICATIONS

Elinson, et al., "The Emission of Hot Electrons and the Field Emission of Electrons from Tin Oxide", *Radio Engineering and Electronic Physics*, pp. 1290–1296, Jul. 1965.

Dittmer, "Electrical Conduction and Electron Emission of Discontinuous Thin Films", *Thin Solid Films*, vol. 9, pp.317–328, 1972.

Hartwell, et al., "Strong Electron Emission From Patterned Tin–Indium Oxide Thin Films", *International Electron Devices Meeting Technical Digest*, pp. 519–521, 1975.

*Primary Examiner*—Steven Saras

*Assistant Examiner*—David L. Lewis

*Attorney, Agent, or Firm*—Fitzpatrick, Cella, Harper & Scinto

[57] ABSTRACT

A driving method for an electron beam-generating apparatus having an electron source having a plurality of electron-emitting devices, and a plurality of modulation means for modulating electron beams emitted from the electron source in correspondence with information signals comprises applying a cut-off voltage to a first modulation means adjacent to a second modulation means to which an ON voltage is applied as the information signals in modulation of the electron beam.

16 Claims, 13 Drawing Sheets

ELECTRON BEAM-GENERATING APPARATUS, IMAGE-FORMING APPARATUS, AND DRIVING METHODS THEREOF

This application is a continuation of application Ser. No. 08/174,448, filed Dec. 28, 1993, now abandoned.

BACKGROUND OF THE INVENTION

1. Field of the Invention

The present invention relates to a method for driving an electron beam-generating apparatus for formation of a pattern of emitted electron beams in correspondence with information signals. The present invention also relates to a method of driving an image-forming apparatus for formation of an image with a pattern of emitted electron beams. The present invention further relates to an electron beam-generating apparatus and an image-forming apparatus which are driven by the above driving methods.

2. Related Background Art

In recent years, research and development are being made actively and extensively regarding image-forming apparatuses which employ an electron source having a plurality of electron-emitting devices wired in a matrix state: especially, thin flat display apparatuses which employ the above devices. FIG. 3 illustrates schematically an example of one device unit of such an image-forming apparatus.

The image-forming apparatus illustrated in FIG. 3 comprises a plurality of electron-emitting devices "A" arranged in a plane state on a substrate 31, and the electron-emitting devices A are connected to wiring electrodes 32*a*, 32*b* corresponding to respective scanning lines. Above the substrate 31, modulation electrodes 33 are arranged so as to form an XY matrix with the scanning lines, and modulate the electron beam emission of each device in accordance with information signals. The modulation electrode 33 has openings 34 for passage of the electron beams.

The image-forming apparatus shown in FIG. 3 is usually driven as follows. A voltage for electron emission is applied to each of the electron-emitting devices A on one scanning line. Modulation voltages (ON/OFF voltages or gradation voltages for electron beams) are applied to modulation electrodes 33 in accordance with information signals for one scanning line of an image. Thereby a pattern of emitted electrons passing through the openings 34 is formed for the one line. The pattern of the emitted electrons is irradiated onto an image-forming member 35 to form one line of the image thereon. This process is successively conducted for each of the scanning lines for the image to form an entire picture image. If the image-forming member 35 is made of a luminescent material, the image is displayed by a plurality of luminous spots 36.

Conventional methods for driving such an image-forming apparatus as mentioned above which has an electron source constituted of electron-emitting regions arranged in high density involve disadvantages such that the modulation voltages of adjacent electron beams affect each other to deflect electron beam trajectories and to change size and shape of the spots formed on the image-forming member face, thereby lowering the fineness of the formed image.

FIG. 4 shows a disadvantage of a conventional driving method. In FIG. 4, three electron beams are emitted respectively from electron-emitting regions 40*a*, 40*b*, 40*c* for one scanning line, and the electron beams are modulated by modulation electrodes 41*a*, 41*b*, 41*c*. In the case where a positive voltage (ON voltage) is applied to the modulation electrodes, electron beams are irradiated from the electron-emitting regions 40*a*, 40*b*, 40*c* onto the corresponding luminescent members (image-forming members) 42*a*, 42*b*, 42*c*. If the electron-emitting regions are close to each other (high density arrangement), the respective electron beams 44 are deflected and spread after passing through the electron beam passage opening 43, by the forces "f" caused by adjacent modulation electrodes, and the spots spread undesirably on each of the luminescent members.

In FIG. 5, three electron beams are emitted from the electron-emitting regions 50*a*, 50*b*, 50*c* for one scanning line, and the electron beams are modulated by the modulation electrodes 51*a*, 51*b*, 51*c*. In the case where a positive voltage (ON voltage) is applied to the modulation electrodes 51*b* and 51*c* and a negative voltage (cut-off voltage) to the modulation electrode 51*a* respectively, the electron beams 54 from the electron-emitting regions 50*b*, 50*c* pass through the electron passage openings 53, and thereafter the trajectories of the respective electron beams 54 are deflected by the forces "f" exerted by the adjacent modulation electrodes 51*b*, 51*c*, as shown in FIG. 5, and the spots formed on the luminescent members 52*b*, 52*c* are asymmetric.

As shown in the above example, in the conventional driving method for an image-forming apparatus employing an electron source in which a plurality of electron-emitting regions are arranged, each electron beam emission pattern for the scanning line varies in electron beam trajectories, spot sizes, and spot shapes, which makes difficult the formation of fine, sharp, high-contrast images. This problem is serious, in particular, in color image-forming apparatus in which red, blue, and green luminescent members are sequentially arranged as image-forming members, because the aforementioned variation in electron beam trajectories, spot sizes, and spot shapes causes collision of the electron beams against luminescent members of unintended colors to give a less reproducible image of lower color purity and color tone irregularity, which makes it impossible to high density arrangement of the luminescent members. The above disadvantage is much more serious when the voltage (ON voltage) of the modulation electrode is raised in order to increase the quantity of electrons reaching the image-forming member. Therefore, it is impracticable to increase sufficiently the quantity of the electron irradiation onto the image-forming member and to raise the luminance and the contrast of the image as desired.

SUMMARY OF THE INVENTION

An object of the present invention is to provide a driving method for an image-forming apparatus and an electron beam-generating apparatus to obtain an image with high fineness, high sharpness, and high contrast.

Another object of the present invention is to provide a driving method for an image-forming apparatus and an electron beam-generating apparatus to obtain a full-color image with extremely less irregularity of color tone with high color reproducibility.

According to an aspect of the present invention, there is provided a driving method for an electron beam-generating apparatus having an electron source having a plurality of electron-emitting devices, and a plurality of modulation means for modulating electron beams emitted from the electron source in correspondence with information signals, the driving method comprising applying a cut-off voltage to a first modulation means adjacent to a second modulation means to which an ON voltage is applied as the information signals in modulation of the electron beam.

According to a further aspect of the present invention, there is provided an electron beam-generating apparatus having an electron source having a plurality of electron-emitting devices, and a plurality of modulation means for modulating electron beams emitted from the electron source in correspondence with information signals, which is driven by the method stated in the preceding paragraph.

According to another aspect of the present invention there is provided a driving method for an electron beam-generating apparatus having an electron source having a plurality of electron-emitting devices, and a plurality of modulation means for modulating electron beams emitted from the electron source in correspondence with information signals, the driving method comprising dividing information signals into a plurality of portions and inputting each of the portions to the modulation means successively in modulation of the electron beams.

According to a further aspect of the present invention, there is provided an electron beam-generating apparatus having an electron source having a plurality of electron-emitting devices, and a plurality of modulation means for modulating electron beams emitted from the electron source in correspondence with information signals, which is driven by the method stated in the preceding paragraph.

According to still another aspect of the present invention, there is provided a driving method for an electron beam-generating apparatus having an electron source having a plurality of electron-emitting devices, and a plurality of modulation means for modulating electron beams emitted from the electron source in correspondence with information signals, the driving method comprising dividing information signals into a plurality of portions and inputting each of the portions to the modulation means at intervals of n rows ($n \geqq 1$) of the modulation means successively "n+1" times, and inputting cut-off signals to other rows of the modulation means to which information signals are not being inputted.

According to a further aspect of the present invention, there is provided an electron beam-generating apparatus having an electron source having a plurality of electron-emitting devices, and a plurality of modulation means for modulating electron beams emitted from the electron source in correspondence with information signals, which is driven by the method stated in the preceding paragraph.

According to a further aspect of the present invention, there is provided a driving method for an image-forming apparatus having an electron source having a plurality of electron-emitting devices, a plurality of modulation means for modulating electron beams emitted from the electron source in correspondence with information signals, and an image-forming member for forming an image by irradiation of modulated electron beams, the driving method comprising applying a cut-off voltage to a first modulation means adjacent to a second modulation means to which an ON voltage is applied as the information signals in modulation of the electron beams.

According to a further aspect of the present invention, there is provided an image-forming apparatus having an electron source having a plurality of electron-emitting devices, a plurality of modulation means for modulating electron beams emitted from the electron source in correspondence with information signals, and an image-forming member for forming an image on irradiation of modulated electron beams, which is driven by the driving method stated in the preceding paragraph.

According to a further aspect of the present invention, there is provided a driving method for an image-forming apparatus having an electron source having a plurality of electron-emitting devices, a plurality of modulation means for modulating electron beams emitted from the electron source in correspondence with information signals, and an image-forming member for forming an image on irradiation of modulated electron beams, the driving method comprising dividing information signals into a plurality of portions and inputting each of the portions to the modulation means successively in modulation of the electron beams.

According to a further aspect of the present invention, there is provided an image-forming apparatus having an electron source having a plurality of electron-emitting devices, a plurality of modulation means for modulating electron beams emitted from the electron source in correspondence with information signals, and an image-forming member for forming an image on irradiation of modulated electron beams, which is driven by the driving method stated in the preceding paragraph.

According to a still further aspect of the present invention, there is provided a driving method for an image-forming apparatus having an electron source having a plurality of electron-emitting devices, a plurality of modulation means for modulating electron beams emitted from the electron source in correspondence with information signals, and an image-forming member for forming an image on irradiation of modulated electron beams, the driving method comprising dividing information signals into a plurality of portions and inputting each of the portions to the modulation means at intervals of n rows ($n \geqq 1$) of the modulation means fractionally and successively "n+1" times, and inputting cut-off signals to other rows of the modulation means to which information signals are not being inputted.

According to a further aspect of the present invention, there is provided an image-forming apparatus having an electron source having a plurality of electron-emitting devices, a plurality of modulation means for modulating electron beams emitted from the electron source in correspondence with information signals, and an image-forming member for forming an image on irradiation of modulated electron beams, which is driven by the driving method stated in the preceding paragraph.

DETAILED DESCRIPTION OF THE PREFERRED EMBODIMENTS

The present invention is described below in more detail.

Figure 3:
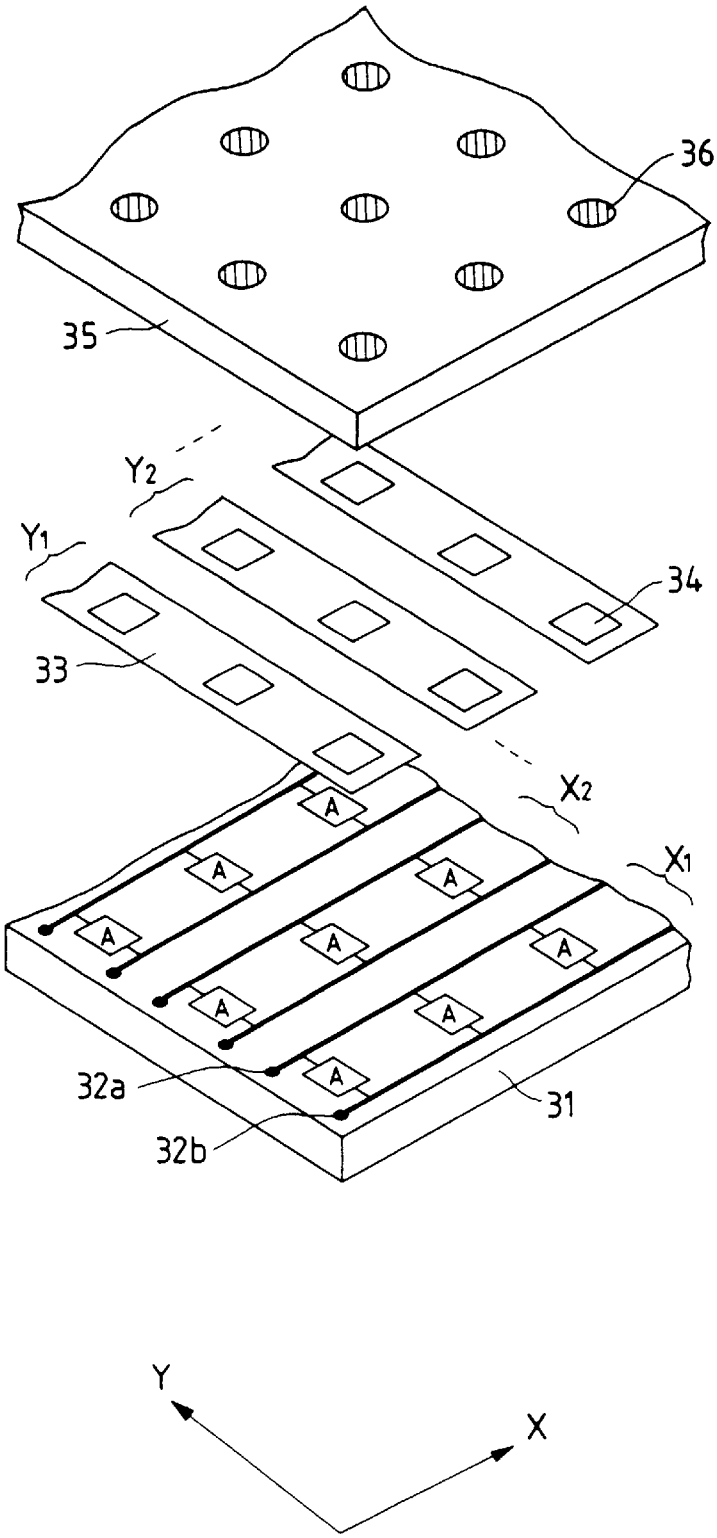
FIG. 3 PRIOR ART
FIG. 3 illustrates schematically a conventional image-forming apparatus.
Figure 4:
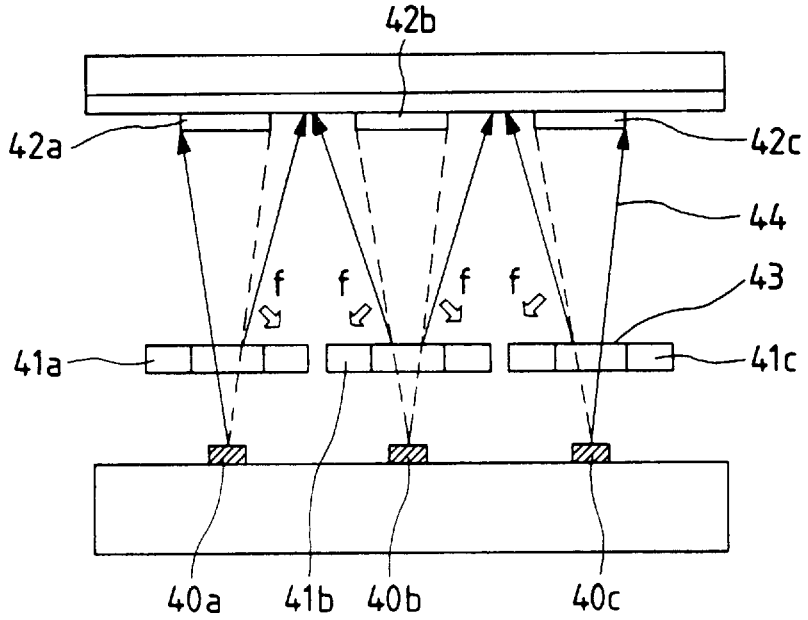
FIG. 4 PRIOR ART
FIG. 4 illustrates a problem in a conventional driving method.
Figure 5:
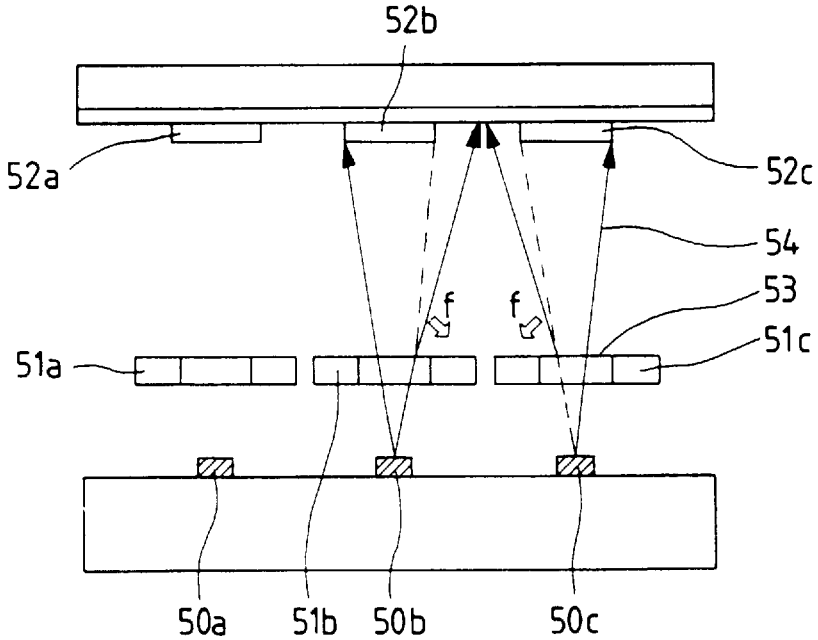
FIG. 5 PRIOR ART
FIG. 5 also illustrates a problem in a conventional driving method.

FIG. 3 shows, as an example, an apparatus in which electron-emitting device lines ($X_1$, $X_2$, . . . ) having respectively a plurality of electron-emitting devices A, and modulation electrodes ($Y_1$, $Y_2$, . . . ) are arranged to form an XY matrix (or in rows and columns) with the electron-emitting device lines. With this apparatus, a voltage Vf for electron emission is applied to one of the electron beam-emitting device lines ($X_1$, $X_2$, . . . ), and voltages are applied to the modulation electrodes ($Y_1$, $Y_2$, . . . ) in correspondence with information signals for the one device line to form an electron emission pattern for the one device line of information signals. This procedure is conducted successively for the respective electron-emitting device lines to form an electron beam emission pattern for a picture image. An image is formed by irradiation of the electron-beam emission pattern onto the image-forming member 35.

In the driving method of the present invention, in application of voltage to the modulation electrodes ($Y_1$, $Y_2$, . . . ) in correspondence with information signals, a cut-off voltage is applied to modulation electrodes (e.g., $Y_1$ and $Y_3$) adjacent to the ON voltage-applied modulation electrode (e.g., $Y_2$) irrespectively of the information signals. In such a driving method, the electron beams irradiated by an ON voltage onto the image-forming member are not adversely affected by the voltage applied to the adjacent modulation electrodes.

In an example of the aforementioned driving method of the present invention, information signals are inputted to the modulation electrodes at intervals of n rows of the modulation electrodes ($n \geqq 1$) divisionally and successively "n+1" times, and cut-off signal is inputted to other rows of the modulation electrodes to which no information signal is inputted.

Figure 1:
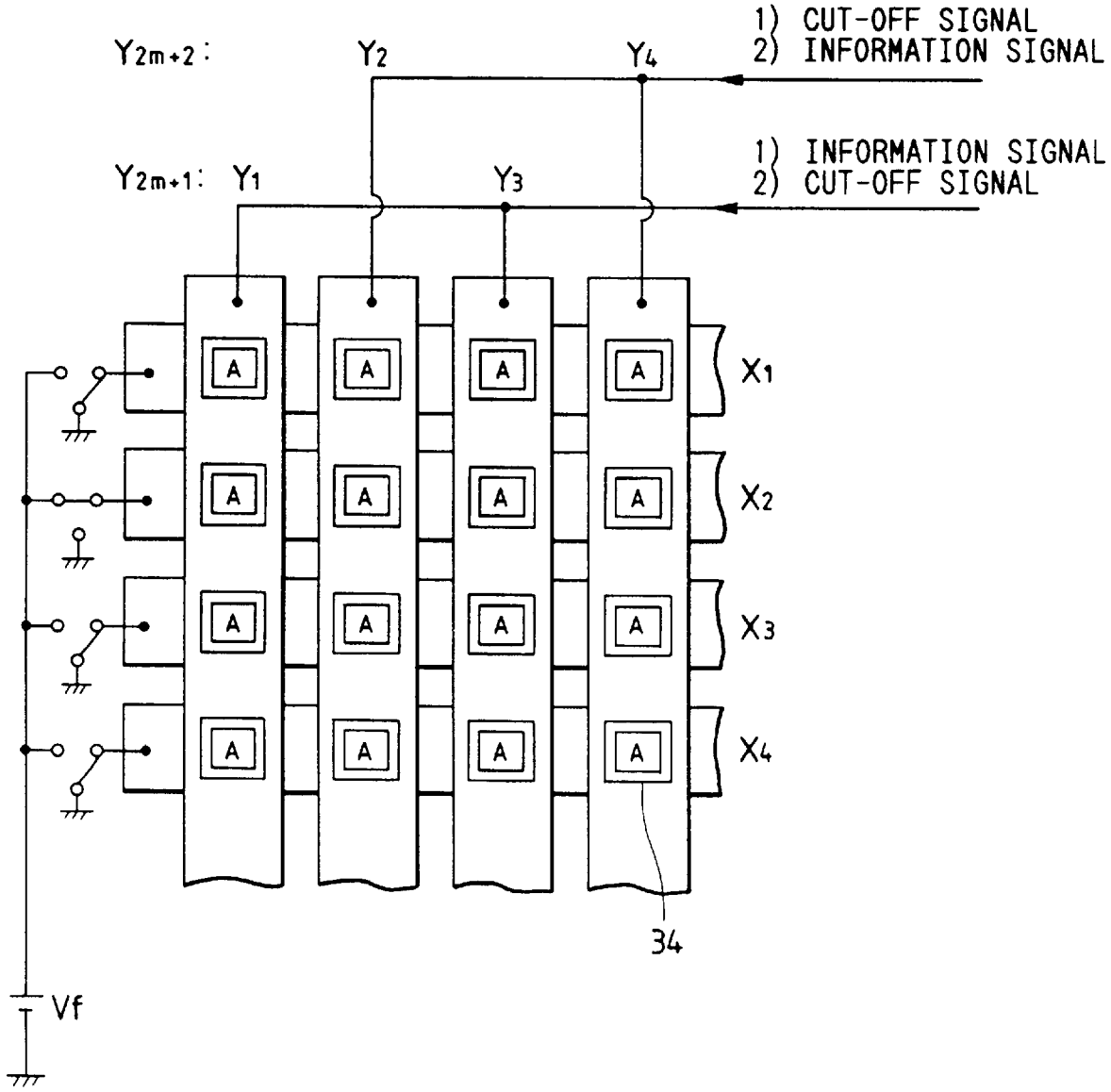
FIG. 1 is a drawing for explaining a driving method of the present invention.

FIG. 1 shows an example of a driving method of the device of FIG. 3 at n=1. In FIG. 1, the information signals are inputted to odd-numbered rows of modulation electrodes and even-numbered ones divisionally two times, and cut-off signals are inputted to the modulation electrodes to which no information signal is inputted. For example, the voltage Vf necessary for electron emission is applied to the $X_2$-th line of the electron-emitting devices. For inputting the information signals to the modulation electrodes ($Y_1$, $Y_2$, $Y_3$, . . . ), (1) firstly information signals are inputted to $Y_{2m+1}$-th modulation electrodes (m=0, 1, 2, . . . ) and cut-off signals are inputted to $Y_{2m+2}$-th modulation electrodes, respectively, and (2) then information signals are inputted to $Y_{2m+2}$-th modulation electrodes and cut-off signals are inputted to $Y_{2m+1}$-th modulation electrodes, respectively. Thereby an electron beam emission pattern is formed corresponding to the information signals for the $X_2$-th line. The above procedure is conducted successively for each of the electron-emitting device lines to form an electron beam-emission pattern for a picture image. A picture image is formed on an image-forming member by irradiating the above electron beam emission pattern thereon.

Figure 2:
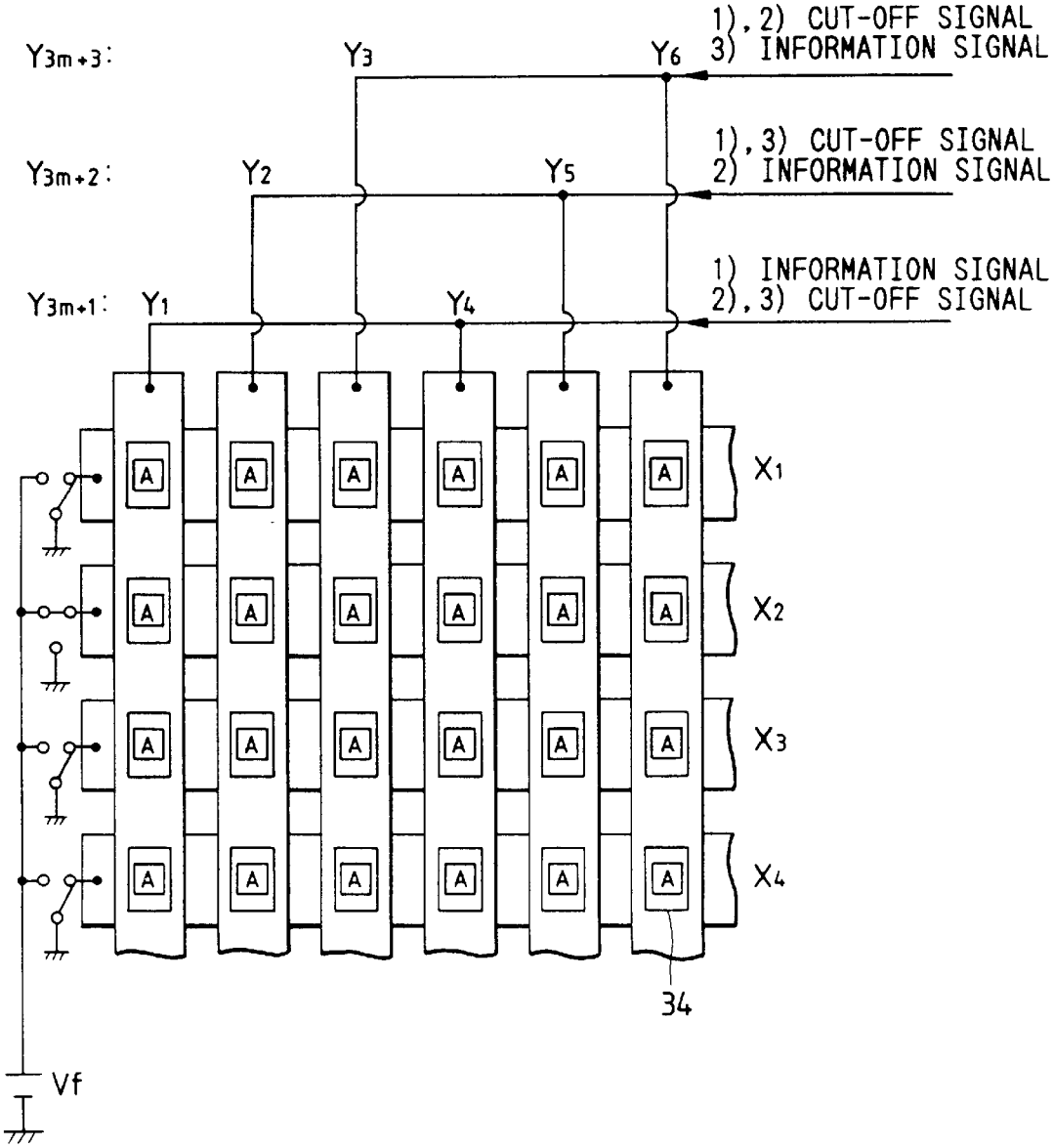
FIG. 2 is a drawing for explaining another driving method of the present invention.

FIG. 2 shows another example where the value of n is 2 in the device of FIG. 3. In FIG. 2, the information signals are inputted divisionally at intervals of two rows of modulation electrodes three times. In each time, cut-off signals are inputted to the modulation electrodes to which information signals are not inputted. For example, the voltage Vf for electron emission is applied to $X_2$-th line of the electron-emitting devices. For inputting the information signals to the modulation electrodes, (1) firstly information signals are inputted to $Y_{3m+1}$-th rows of the modulation electrodes, and cut-off signals are inputted to $Y_{3m+2}$-th and $Y_{3m+3}$-th rows of modulation electrodes, respectively, and (2) then information signals are inputted to $Y_{3m+2}$-th rows of modulation electrodes and cut-off signals are inputted to $Y_{3m+1}$-th and $Y_{3m+3}$-th rows of modulation electrodes, respectively, and (3) finally information signals are inputted to $Y_{3m+3}$-th rows of modulation electrodes and cut-off signals are inputted to $Y_{3m+1}$-th and $Y_{3m+2}$-th rows of modulation electrodes, respectively. Thereby electron beam emission pattern is formed corresponding to the information signals for the $X_2$-th electron-emitting device line. The above procedure is conducted successively for each of the electron-emitting device lines to form an electron beam-emission pattern for a picture image. A picture image is formed on an image-forming member by irradiating the above electron beam emission pattern thereon.

A suitable voltage is applied to the image-forming member in order to irradiate effectively the electron beam pattern emitted from the electron source. The magnitude of this voltage is suitably selected depending on the ON voltage, the cut-off voltage, and the kind of the electron-emitting device employed.

The aforementioned information signals (or modulation signals) include an ON signal which allows the irradiation of an electron beam onto the image-forming member in an amount of larger than a certain level, and a cut-off signal which shuts out the irradiation of an electron beam onto the image-forming member. If gradation of the display is desired, the information signals include also gradation signals which vary the quantity of the electron beam irradiation onto the image-forming member. The ON signal and the cut-off signal are suitably selected depending on the kind of the electron-emitting device, the voltage applied to the image-forming member, and so forth.

The electron beam-generating apparatus or the image-forming apparatus which is driven according to the driving method of the present invention may comprise a full-color image-forming member in which fluorescent member of red (R), green (G), and blue (B) are arranged.

Preferred examples of modulation means and electron-emitting devices of the apparatus are described below in which the driving method of the present invention is suitably employed.

Firstly, an example of a particularly preferred modulation means for the electron-generating apparatus and the image-forming apparatus is described below.

Figure 6:
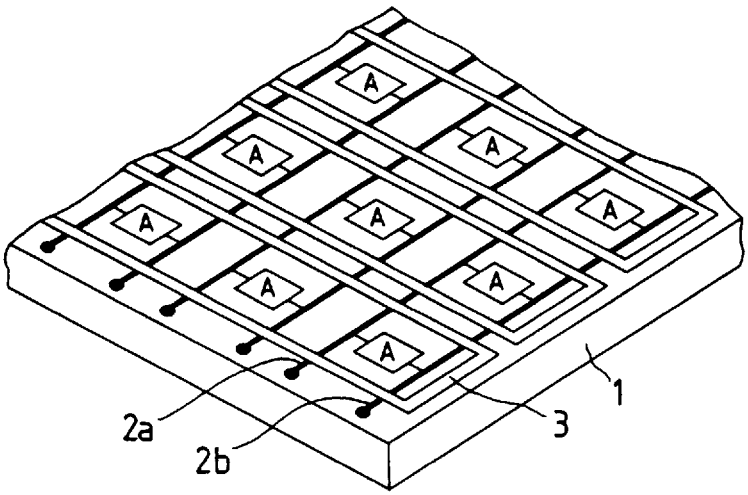
FIG. 6 schematically illustrates embodiment of an electron source portion of an image-forming apparatus of the present invention.
Figure 7:
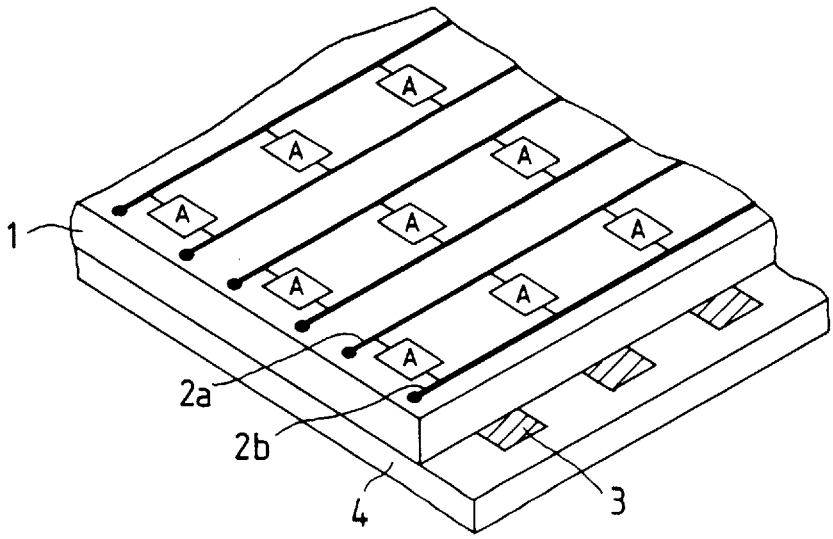
FIG. 7 schematically illustrates another embodiment of an electron source portion of an image-forming apparatus of the present invention.
Figure 8:
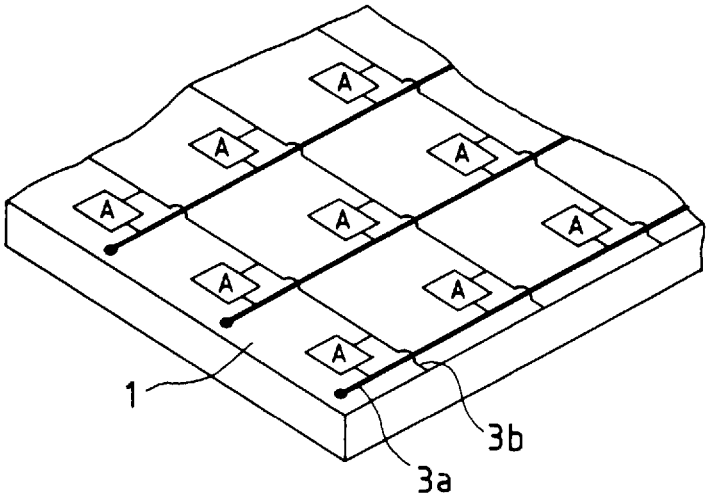
FIG. 8 schematically illustrates still another embodiment of an electron source portion of an image-forming apparatus of the present invention.

FIG. 6 illustrates an embodiment in which electron-emitting devices A and modulation electrodes 3 are both provided on one and the same face of a substrate 1, and FIG. 7 illustrates another embodiment in which electron-emitting devices A are provided on an insulating substrate 1 and modulation electrodes are laminated on the reverse face of the substrate 1. In these embodiments, electron-emitting device lines having respectively a plurality of electron-emitting regions between wiring electrodes 2*a*, 2*b*, and modulation electrodes 3 are arranged in an XY matrix. FIG. 8 shows an embodiment called simple matrix construction generally, in which a plurality of electron-emitting devices A are arranged in a matrix and each of the devices is connected with a signal wiring electrode 3*b* and a scan-wiring electrode 3*a*.

The modulation means for any of the above three embodiments does not require strict positional registration as that required in the modulation electrodes shown in FIG. 3 between an electron-emitting region and an electron passage opening 34, and therefore does not cause irregularity of luminance in luminous image like that caused by positional deviation of the electron passage opening from the electron-emitting region.

In the devices employing the driving method of the present invention, the type of the electron-emitting devices are not specially limited, but cold cathode type devices are preferred. In the case where a plurality of hot cathodes are employed, uniform electron emission characteristics in a large area are not obtainable since electron emission characteristics of the hot cathode are affected by temperature distribution. Further, as the electron-emitting devices, surface conduction type electron-emitting devices are preferred in the present invention.

The surface conduction type electron-emitting devices are known, and is exemplified by a cold cathode device disclosed by M. I. Elinson, et al. (Radio Eng. Electron Phys. Vol. 10, pp. 1290–1296 (1965)). This device utilizes the phenomenon that electrons are emitted from a thin film of small area formed on a substrate on application of electric current in a direction parallel to the film face. The surface conduction type electron-emitting device, in addition to the above-mentioned one disclosed by Elinson et al. employing $SnO_2$(Sb) thin film, includes the one employing an Au thin film (G. Dittmer: "Thin Solid Films", Vol. 9, p. 317 (1972)), the one employing an ITO thin film (M. Hartwell, and C. G. Fonstad: "IEEE Trans. ED Conf.", p. 519 (1983)), and so forth.

Figure 9:
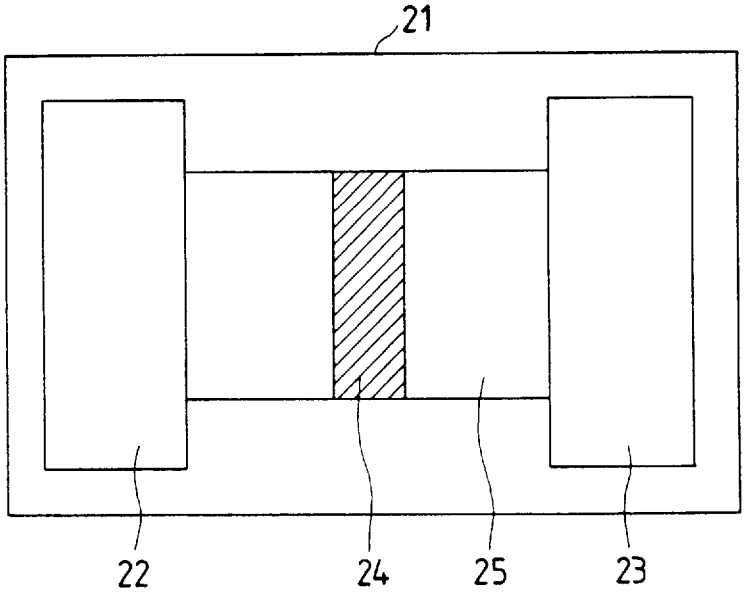
FIG. 9 PRIOR ART
FIG. 9 is a schematic plan view of a conventional surface conduction type electron-emitting device.

FIG. 9 illustrates a typical device constitution of such surface conduction type electron-emitting devices. The device in FIG. 9 comprises electrodes 22, 23 for electric connection, a thin film 25 formed of an electron-emitting substance, a substrate 21, and an electron-emitting region 24. Conventionally, in such a surface conduction type electron-emitting device, the electron-emitting region is formed by a voltage application treatment, called "forming", of an emitting region prior to use for electron emission. The forming is a treatment of flowing electric current through the thin film 25 by application of a voltage between the electrodes 22, 23, thereby the emitting region-forming thin film being locally destroyed, deformed, or denatured by the generated Joule's heat to form the electron-emitting region 24 in a state of high electric resistance. Here, the state of high electric resistance means a discontinuous state of a part of the thin film 25 in which cracks having an "island structure" therein are formed. The portion of the thin film in such a state is spatially discontinuous but is continuous electrically. The surface conduction type electron-emitting device emits electrons, when voltage is applied between the electrodes 22, 23 to allow electric current to flow through the highly resistant discontinuous film on the surface of the device surface.

Figure 10:
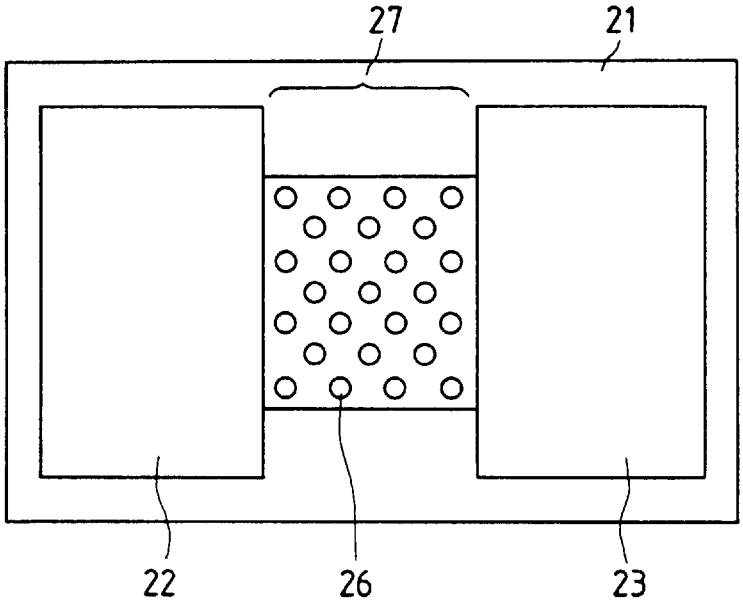
FIG. 10 PRIOR ART
FIG. 10 is a schematic plan view of another conventional surface conduction type electron-emitting device.

The inventors of the present invention disclosed, in Japanese Patent Application Laid-Open Nos. 1-200532 and 2-56822, a novel surface conduction type electron-emitting device in which fine particles for emitting electrons are disposed in dispersion between electrodes. The inventors of the present invention later found that the above surface conduction type electron-emitting device is particularly excellent in the electron emission efficiency, the stability of the emitted electrons, and so forth, when the dispersed fine particles have an average particle diameter in the range of from 5 Å to 300 Å, and the intervals of the fine particles are in the range of from 5 Å to 100 Å. Such a type of surface conduction type electron-emitting devices having dispersed fine particles have advantages of (1) high electron emission efficiency, (2) simple structure and ease of production, (3) possibility of arrangement of a large number of devices on one substrate, and so forth. FIG. 10 shows a typical device constitution of the surface conduction type electron-emitting device. In FIG. 10, the device comprises device electrodes for electric connection 22, 23, electron-emitting region 27 in which fine particles 26 for emitting electrons are disposed in dispersion, and a substrate 21.

The present invention is described below in more detail by reference to Examples.

EXAMPLE 1

The device driven according to the present invention in this Example was an image-forming apparatus having surface conduction type electron-emitting devices and was driven as described below.

[Preparation Example of Image-Forming Apparatus]

Figure 12:
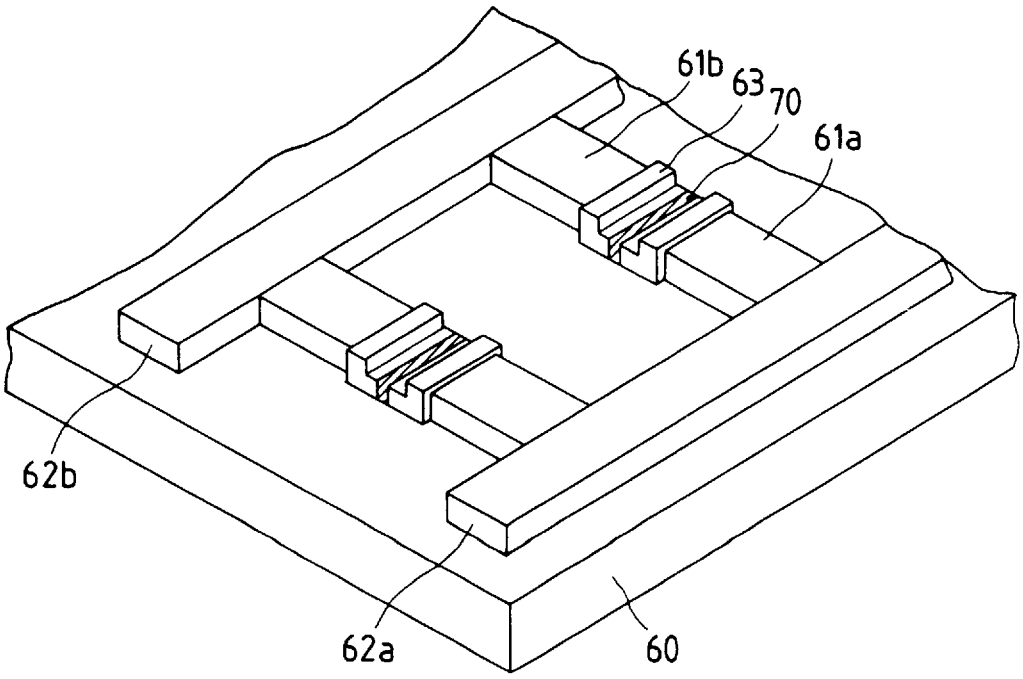
FIG. 12 is an enlarged view of a part of an electron source of the present invention.

The method for preparation of the image-forming apparatus is explained by reference to FIGS. 11 and 12.

(1) Device electrodes 61*a*, 61*b*, and wiring electrodes 62*a*, 62*b* were formed on a glass substrate as the insulating substrate 60. The electrodes were formed from metallic nickel in this Example, but the material therefor is not limited provided that it is electroconductive. The gap between the electrodes 61*a*, 61*b* was 2 $\mu$m, and the pitch of the wiring electrodes 62*a*, 62*b* was 0.5 mm.

(2) Organic palladium (CCP-4230, made by Okuno Seiyaku K.K.) was applied between the electrodes 61*a*, 61*b*, and the applied matter was baked at 300° C. for one hour to form a fine particle film 63 composed of palladium oxide.

(3) Above the substrate 60, the modulation electrodes 64 having electron passage openings 65 were placed and fixed in an XY matrix so as to be perpendicular to the wiring electrodes 62*a*, 62*b*.

(4) A face plate 68 having a transparent electrode 66 and a fluorescent member 67 on its inside face was placed 4 mm above the substrate 60 by aid of a supporting frame 69. Frit glass was applied to the joint portion between the supporting frame 69 and the face plate 68, and was baked at 430° C. for more than 10 minutes.

(5) The enclosure prepared as above (constituted of the substrate 60, the supporting frame 69, and the face plate 68) was evacuated by a vacuum pump to a sufficient vacuum degree (preferably from $10^{-6}$ torr to $10^{-7}$ torr). Then voltage pulse of a desired waveform was applied between the wiring electrodes 62*a*, 62*b* to form electron emitting regions 70 between the device electrodes 61*a*, 61*b*. The pitch of the electron-emitting region was made to be 0.5 mm. The fine particles in the electron-emitting region had an average particle diameter of 100 Å, and the interval between the particles was 20 Å according to SEM observation.

The image-forming apparatus was prepared as above which comprises an electron source having electron-emitting devices arranged in a matrix. With this apparatus, at a voltage of from 5 to 10 kV applied to the transparent electrode 66, cut-off control was practicable at a voltage of the modulation electrode 64 of −30 V or more negative voltage; ON control was practicable at a voltage thereof of zero volt or higher; and gradational display was practicable by continuously changing the quantity of the electrons of p the emitted electron beam in the range of from −30 V to 0 V. In FIG. 11, the numeral 71 denotes luminous spots of the fluorescent member.

[Example of Device-Driving Method]

Figure 13:
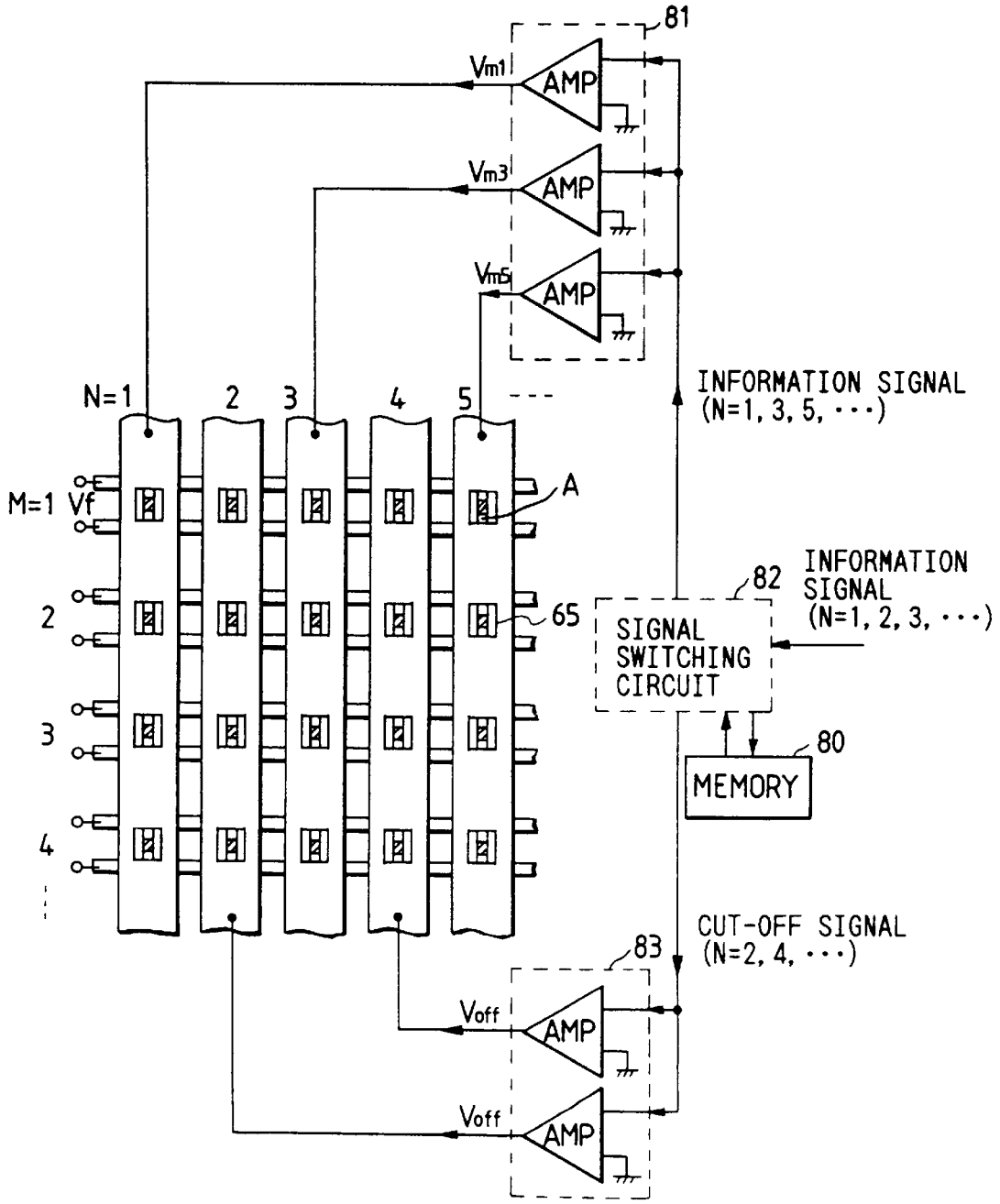
FIG. 13 is a drawing for explaining a driving method of the present invention.

The method of driving the device of the present invention is explained by reference to FIG. 13 for the case where scanning is conducted from the electron-emitting device line of M=1:

(1) A constant voltage is applied to the transparent electrode 66 (FIG. 11) by a voltage application means (not shown in the drawing), and electron emission voltage Vf is applied to the electron-emitting device line (or scanning line) of M=1.

(2) Of the information signals for the scanning line of M=1, information signals to be inputted to even-numbered modulation electrodes (N=2, 4, . . . ) are stored in a memory 80, while the information signals to be inputted to odd-numbered modulation electrodes (N=1, 3, 5, . . . ) are inputted directly thereto by a voltage application means 81 as modulation voltages ($Vm_1$, $Vm_3$, $Vm_5$, . . . ) including ON voltages, cut-off voltages and gradation voltages in corresponding with the information signals. During this period, a cut-off voltage ($V_{off}$) is applied to the even-numbered modulation electrodes (N=2, 4, . . . ) irrespectively of the information signals according to cut-off the signals sent out from the signal switching circuit (signal separation means) 82 to a voltage application means 83.

(3) Then the signal switching circuit 82 switches the circuit so as to input, to the even-numbered modulation electrodes, the portion of the information signals for the scanning line (M=1) stored in the memory 80. Thereby modulation voltages ($Vm_2$, $Vm_4$, . . . ) including ON voltages, cut-off voltages and gradation voltages are inputted to even-numbered modulation electrodes through the voltage application means 83 in correspondence with the information signals. During this period, a cut-off voltage ($V_{off}$) is applied to the odd-numbered modulation electrodes (N=1, 3, 5, . . . ) irrespectively of the information signals according to cut-off the signals sent out from the signal switching circuit 82 to a voltage application means 81.

As described above, the process of inputting information signals of one scanning line in two steps separately for odd-numbered modulation electrodes and even-numbered ones is conducted within the time of scanning of one line of display.

The above steps of (1) to (3) are practiced for each scanning line sequentially to display one or more picture images on a fluorescent member face.

According to the driving method of this Example, respective luminous spots forming an image display on the fluorescent member face were extremely uniform in size and shape, and gave extremely fine and sharp image without crosstalk.

Figure 11:
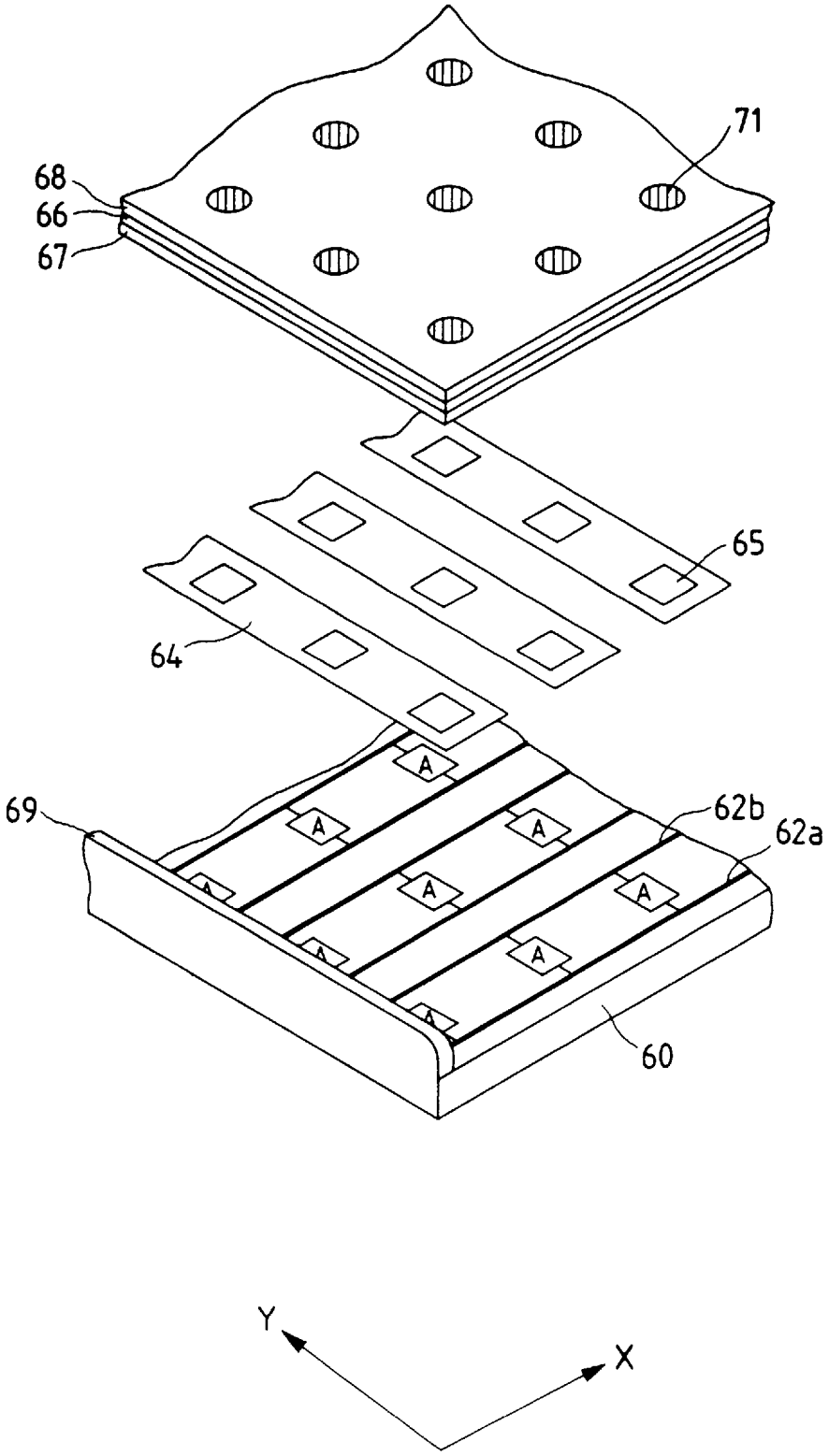
FIG. 11 illustrates schematically constitution of an image-forming apparatus of the present invention.
Figure 14:
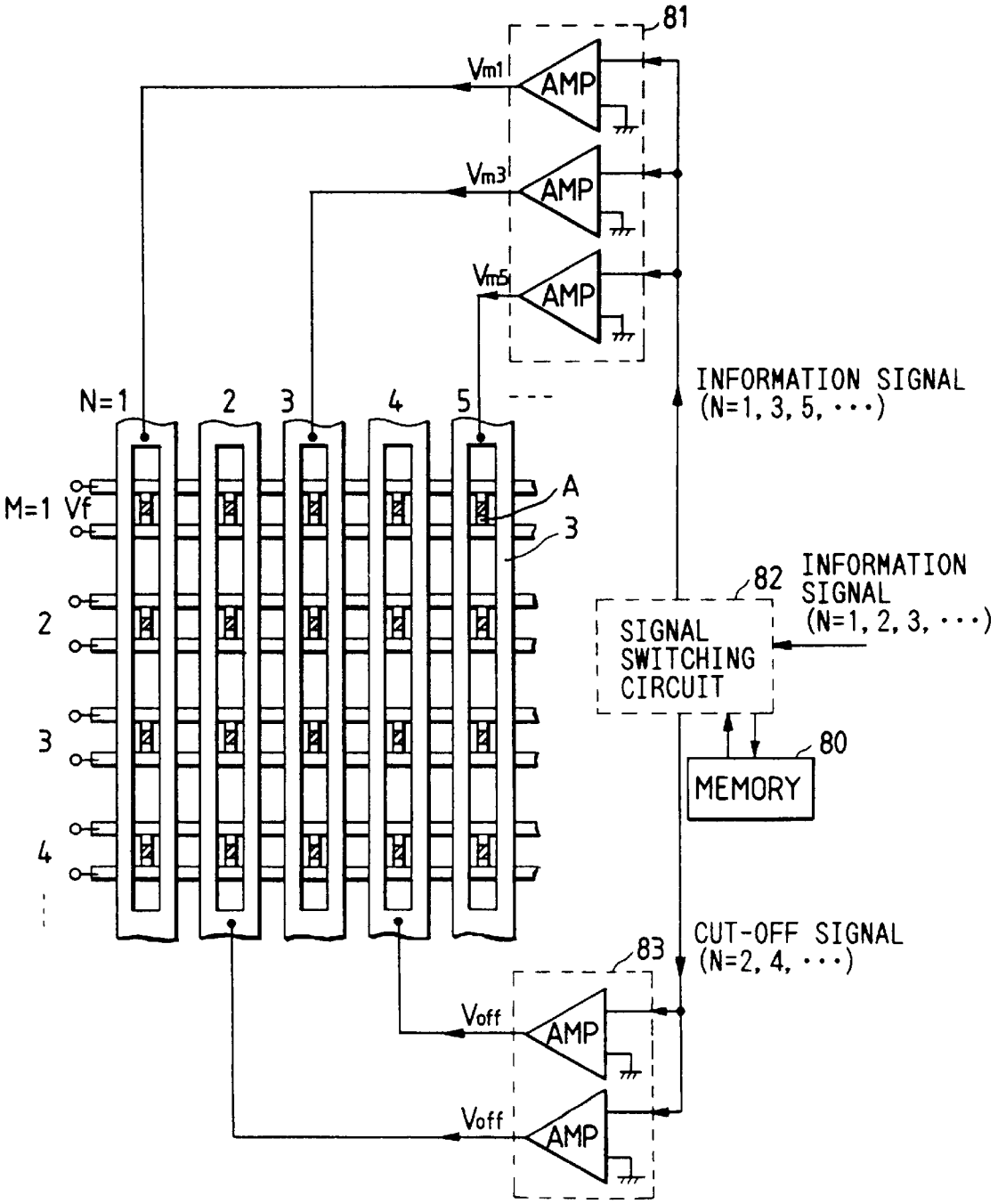
FIG. 14 is a drawing for explaining another driving method of the present invention.
Figure 15:
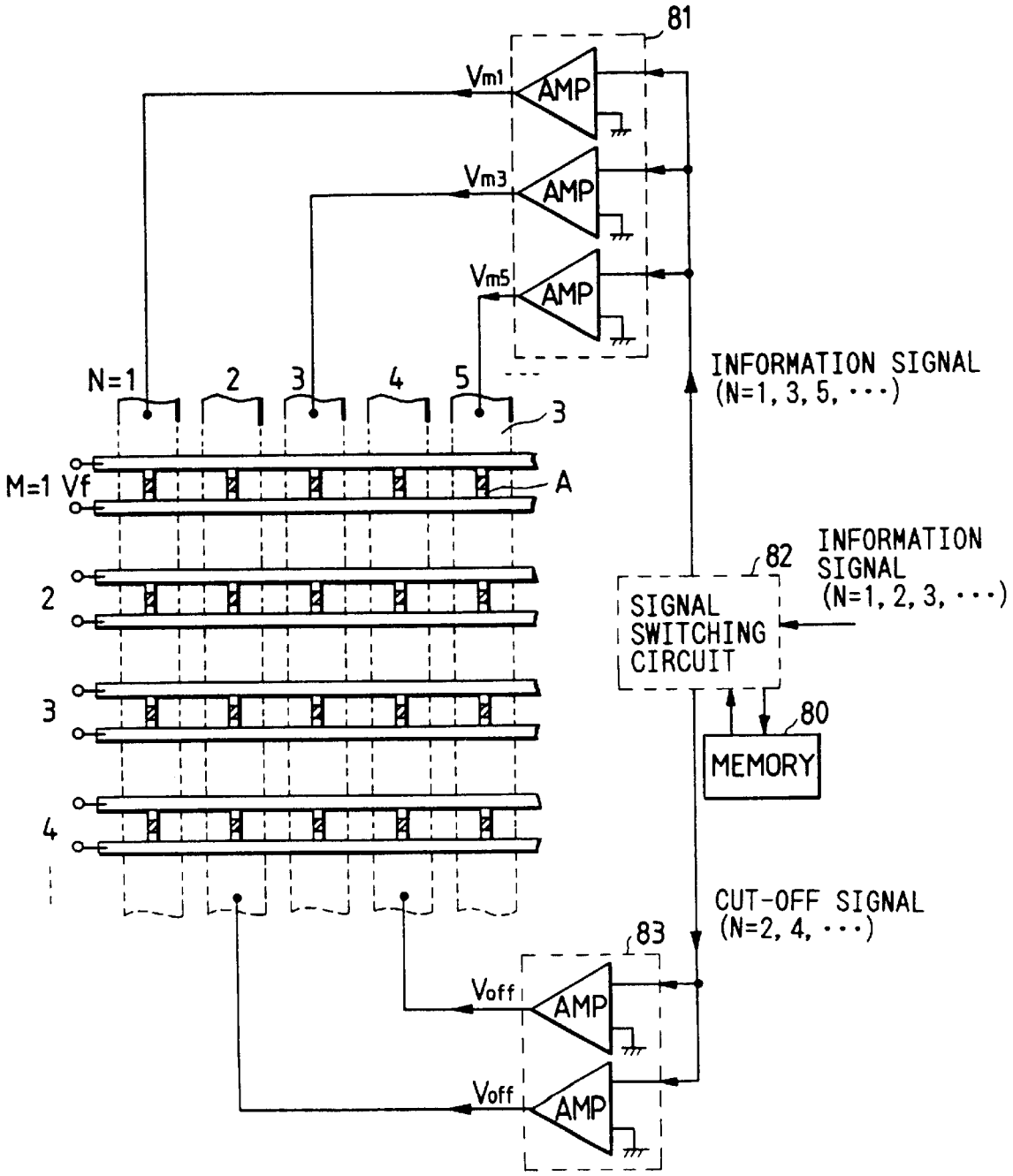
FIG. 15 is a drawing for explaining still another driving method of the present invention.

The modulation electrodes, which are arranged in as in FIG. 11 in this Example, may be the ones as shown in FIG. 6, or FIG. 7. With any embodiment of the modulation electrodes, a similar driving method as in this Example (FIGS. 14 and 15) gave an image displayed with spots of uniform and stable sizes and shapes with high fineness without crosstalk. In the embodiments of FIG. 6 and FIG. 7, at an application voltage of the transparent electrodes of from 5 to 10 kV, the electron beam could be cut off at the modulation voltage of −40 V or more negative voltage, turned on at 10 V or higher, continuously controlled between −40 V and 10 V for gradational display.

EXAMPLE 2

Figure 16:
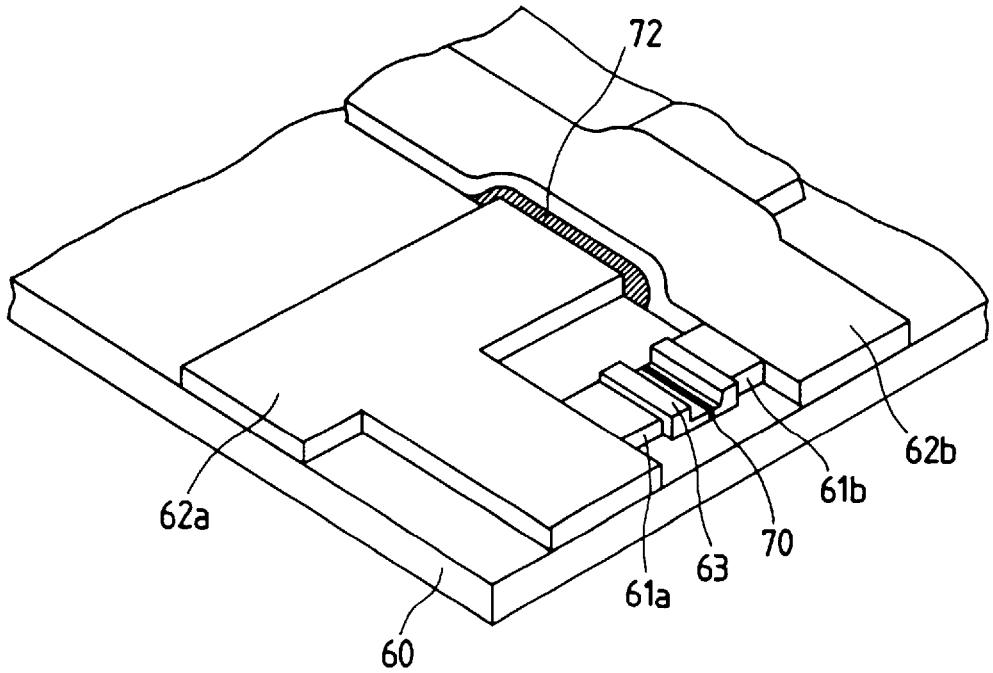
FIG. 16 is an enlarged view of a part of another electron source of the image-forming apparatus of the present invention.
Figure 18:
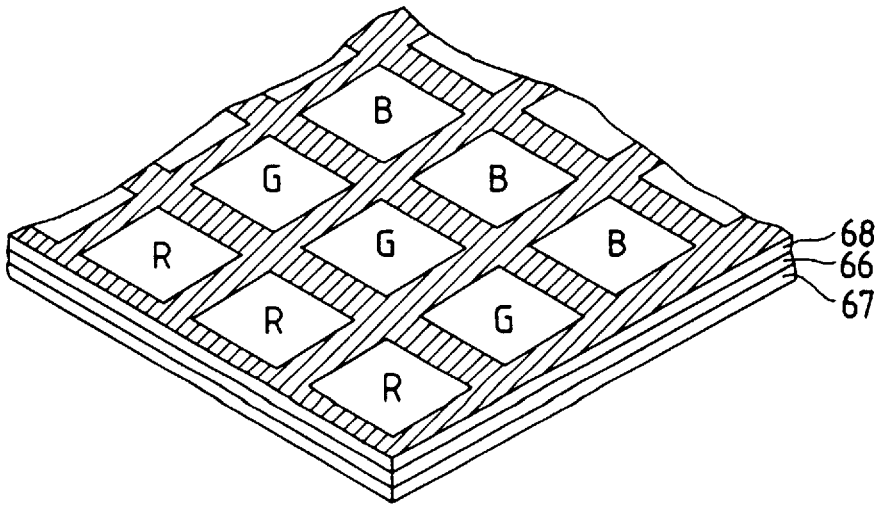
FIG. 18 illustrates another embodiment of an image-forming member of an image-forming apparatus of the present invention.

The image-forming apparatus in this Example was prepared in the same manner as in Example 1 except that the device electrodes 61*a*, 61*b* and the wiring electrodes 62 are arranged as shown in FIGS. 8 and 16, modulation electrodes of Example 1 was not provided, and fluorescent materials of red (R), green (G), and blue (B) were arranged in a black stripe constitution as shown in FIG. 18 such that one fluorescent material (R, G, or B) corresponds to one electron-emitting device.

In this working example, instead of such a modulation electrode as used in Example 1, a signal-wiring electrode described later plays the same part as the transparent electrode does in Example 1.

[Example of Device-Driving Method]

Figure 17:
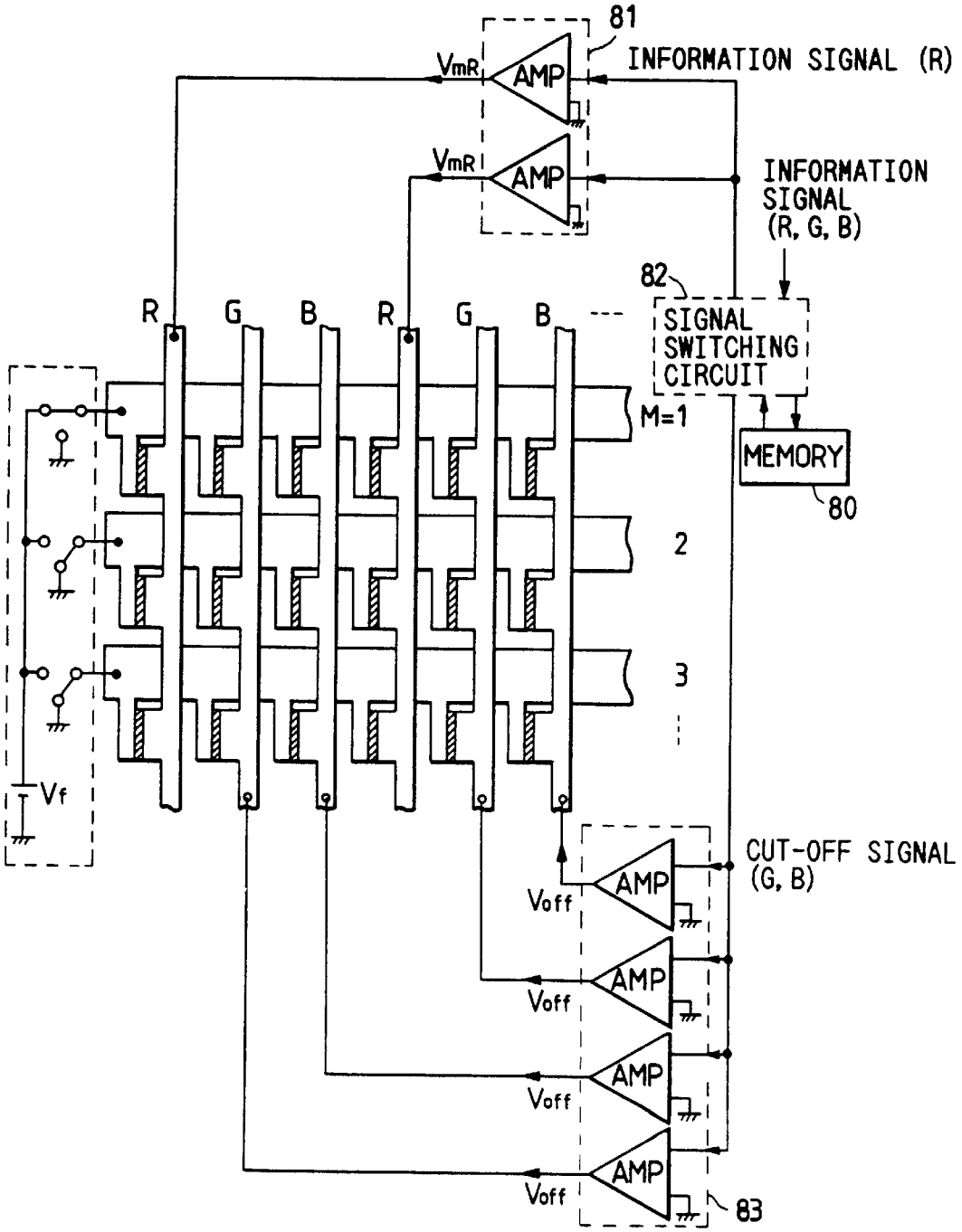
FIG. 17 is a drawing for explaining still another driving method of the present invention.

The method of driving the device of the present invention is explained by reference to FIG. 17 for the case where scanning is conducted from the electron-emitting device line of M=1:

(1) A constant voltage is applied to the transparent electrode by a voltage application means (not shown in the drawing), and electron emission voltage Vf is applied to the electron emission line (or scanning line) of M=1.

(2) Of the information signals for the scanning line of M=1, information signals to be inputted to green-displaying signal wiring electrodes G and blue-displaying signal wiring electrodes B are stored in a memory 80, while the information signals to be inputted to red-displaying signal wiring electrodes R are inputted directly thereto by a voltage application means 81 as modulation voltages (VmR) including ON voltages, cut-off voltages and gradation voltages in correspondence with the information signals. During this period, a cut-off voltage ($V_{off}$) is applied to the signal wiring electrodes G and B irrespectively of the information signals according to cut-off the signals sent out from the signal switching circuit 82 to a voltage application means 83.

(3) The signal switching circuit 82 switches the circuit so as to input, to the signal-wiring electrode G, the portion of the information signals stored in the memory 80 for the green-displaying information signal of the scanning line of M=1, and modulation voltages (VmG) including ON voltages, cut-off voltages and gradation voltages are inputted to the signal wiring electrode G through the voltage application means 81 in correspondence with the information signals. During this period, a cut-off voltage ($V_{off}$) is applied to the signal-wiring electrodes R and B irrespectively of the information signals according to cut-off the signals sent out from the signal switching circuit 82 to the voltage application means 83.

(4) The signal switching circuit 82 switches the circuit so as to input, to the signal-wiring electrode B, the portion of the information signals stored in the memory 80 for the blue-displaying information signal of the scanning line of M=1, and modulation voltages (VmB) including ON voltages, cut-off voltages and gradation voltages are inputted to the signal wiring electrode B through the voltage application means 81 in correspondence with the information signals. During this period, a cut-off voltages ($V_{off}$) is applied to the signal-wiring electrodes R and G irrespectively of the information signals according to cut-off the signals sent out from the signal switching circuit 82 to the voltage application means 83.

As described above, the process of inputting information signals of one scanning line at intervals of two signal-wiring electrodes in three steps for three colors separately is conducted within the time of scanning of one line of display.

As realized from the above description, the application of the modulation voltage to the signal-wiring electrode in the present working example corresponds to the application of voltage to the modulation electrode in Example 1.

The above steps of (1) to (4) are practiced for each scanning line successively to display a full-color picture image on a fluorescent member face.

According to the driving method of this Example, respective luminous spots forming an image display on the fluorescent member faces of each color were extremely uniform in size and shape, and gave a full-color image with improved color purity with excellent color reproducibility without crosstalk.

The modulation electrodes, which are arranged as in FIGS. 8 and 16 in this Example, may be arranged as shown in FIG. 6, FIG. 7, or FIG. 11. With any embodiment of the modulation electrodes, a similar driving method as in this Example gave a full-color image with spots of uniform and stable sizes and shapes with improved color purity with excellent color reproducibility and without crosstalk.

The image-forming apparatus of the present invention will possibly be useful widely in public and industrial application fields such as high-vision TV picture tubes, computer terminals, large-picture home theaters, TV conference systems, TV telephone systems, and so forth.

What is claimed is:

1. A driving method for an electron beam-generating apparatus having a plurality of electron-emitting devices, a plurality of scanning lines to which operating signals for operating a plurality of electron beams emitted from the plurality of electron-emitting devices are inputted, and a plurality of rows of modulation means forming a matrix in cooperation with the plurality of scanning lines to which a plurality of rows of modulation means information signals for modulating a plurality of electron beams emitted from each of the scanning lines is inputted, said driving method comprising the step of:

conducting a modulation operation of the plurality of electron beams with respect to each of the scanning lines in N+1 installments of the modulation operation, wherein the N+1 installments of the modulation operation are operations of dividing the plurality of electron beams emitted from each of the scanning lines into N+1 groups, a unit of the groups corresponding to electron beams arranged at intervals of N rows, where N≧1, and wherein each of the N+1 installments of the modulation operation is characterized by inputting information signals to one group of rows of the modulation means and simultaneously inputting cut-off signals to the remaining N groups of rows of the modulation means.

2. A driving method according to claim 1, wherein the plurality of electron-emitting devices includes a surface conduction type electron-emitting device.

3. A driving method according to claim 1, wherein said driving method drives an electron beam-generating apparatus having an electron source having a plurality of electron-emitting devices, and a plurality of modulation means for modulating electron beams emitted from the electron source in correspondence with information signals.

4. A driving method according to claim 3, wherein the plurality of electron-emitting devices includes a surface conduction type electron-emitting device.

5. A driving method according to claim 4, wherein the electron beam-generating apparatus is used for an image-forming apparatus.

6. A driving method according to claim 4, wherein the electron beam-generating apparatus is used for a display apparatus.

7. A driving method according to claim 3, wherein the electron beam-generating apparatus is used for an image-forming apparatus.

8. A driving method according to 3, wherein the electron beam-generating apparatus is used for a display apparatus.

9. A driving method for an image-forming apparatus having a plurality of electron-emitting devices, a plurality of scanning lines to which operating signals for operating a plurality of electron beams emitted from the plurality of electron-emitting devices are inputted, a plurality of rows of modulation means forming a matrix in cooperation with the plurality of scanning lines to which a plurality of rows of modulation means information signals for modulating a plurality of electron beams emitted from each of the scanning lines is inputted, and an image-forming member for forming an image upon irradiation by the plurality of modulated electron beams, said driving method comprising the step of:

conducting a modulation operation of the plurality of electron beams with respect to each of the scanning lines in N+1 installments of the modulation operation, wherein the N+1 installments of the modulation operation are operations of dividing the plurality of electron beams emitted from each of the scanning lines into N+1 groups, a unit of the groups corresponding to electron beams arranged at intervals of N rows, where N≧1, and wherein each of the N+1 installments of the modulation operation is characterized by inputting information signals to one group of rows of the modulation means and simultaneously inputting cut-off signals to the remaining N groups of rows of the modulation means.

10. A driving method according to claim 9, wherein the plurality of electron-emitting devices includes a surface conduction type electron-emitting device.

11. A driving method according to claim 9, wherein said driving method drives an image-forming apparatus having an electron source having a plurality of electron-emitting devices, a plurality of modulation means for modulating electron beams emitted from the electron source in correspondence with information signals, and an image-forming member for forming an image upon irradiation by the modulated electron beams.

12. A driving method according to claim 11, wherein the plurality of electron-emitting devices includes a surface conduction type electron-emitting device.

13. A driving method according to claim 12, wherein the image-forming apparatus is used for a television picture receiver.

14. A driving method according to claim 12, wherein the image-forming apparatus is used for a computer terminal.

15. A driving method according to 11, wherein the image-forming apparatus is used for a television picture receiver.

16. A driving method according to claim 11, wherein the image-forming apparatus is used for a computer terminal.

* * * * *

UNITED STATES PATENT AND TRADEMARK OFFICE

CERTIFICATE OF CORRECTION

PATENT NO. : 5,818,403
DATED : October 6, 1998
INVENTOR(S) : Naoto Nakamura et al.

It is certified that error appears in the above-identified patent and that said Letters Patent is hereby corrected as shown below:

Title page,
Item [56], References Cited, U.S. PATENT DOCUMENTS, insert -- 5,153,483 10/1992 Kishino, et al. --.
Item [56] References Cited, FOREIGN PATENT DOCUMENTS, "1200532" should read -- 1-200532 --; "2056822" should read -- 2-056822 --; and insert

| | | | |
|---|---|---|---|
| -- | 0349425 | 1/1990 | EPO |
| | 2-150891 | 6/1990 | Japan |
| | 0388984 | 9/1990 | EPO |
| | 4 112078 | 10/1991 | Germany |
| | 1 319389 | 6/1993 | Canada --. |

Column 2,
Line 38, "to" should read -- to achieve --.

Column 4,
Line 54, "illustrates" should read -- illustrates an --.

Column 7,
Line 1, "in" (first occurrence) should be deleted; and
Line 19, "was" should read -- were --.

Column 11,
Line 7, "voltages" should read -- voltage --.

Column 12,
Lines 17 and 62, "to" should read -- to claim --.

Signed and Sealed this

Twenty-eighth Day of May, 2002

*Attest:*

*Attesting Officer*

JAMES E. ROGAN
*Director of the United States Patent and Trademark Office*